US008519926B2

(12) United States Patent
Lim

(10) Patent No.: US 8,519,926 B2
(45) Date of Patent: Aug. 27, 2013

(54) LIQUID CRYSTAL DISPLAY DEVICE AND DRIVING METHOD THEREOF

(75) Inventor: Hong-Youl Lim, Gyeonsangbuk-Do (KR)

(73) Assignee: LG Display Co., Ltd., Seoul (KR)

( * ) Notice: Subject to any disclaimer, the term of this patent is extended or adjusted under 35 U.S.C. 154(b) by 1160 days.

(21) Appl. No.: 11/824,043

(22) Filed: Jun. 29, 2007

(65) Prior Publication Data

US 2008/0001897 A1 Jan. 3, 2008

(30) Foreign Application Priority Data

Jun. 30, 2006 (KR) ..... 10-2006-0061634

(51) Int. Cl.
*G09G 3/36* (2006.01)

(52) U.S. Cl.
USPC ..... 345/87; 345/98; 345/100; 345/101; 345/103; 345/204; 349/152; 349/150; 349/49; 349/149

(58) Field of Classification Search
USPC ..... 345/98, 204, 87; 349/153
See application file for complete search history.

(56) References Cited

U.S. PATENT DOCUMENTS

| | | | | |
|---|---|---|---|---|
| 6,407,729 | B1 | 6/2002 | Moon | |
| 6,545,655 | B1 | 4/2003 | Fujikawa | |
| 6,798,146 | B2 * | 9/2004 | Oota | 315/169.1 |
| 7,075,505 | B2 * | 7/2006 | Sakaguchi et al. | 345/87 |
| 7,123,234 | B2 * | 10/2006 | Moon et al. | 345/98 |
| 7,145,541 | B2 * | 12/2006 | Kurokawa et al. | 345/98 |
| 2003/0085859 | A1 * | 5/2003 | Lee | 345/87 |
| 2004/0227775 | A1 * | 11/2004 | Shimizu et al. | 345/690 |
| 2005/0200579 | A1 | 9/2005 | Chen et al. | |
| 2006/0202929 | A1 * | 9/2006 | Baum et al. | 345/89 |
| 2007/0229423 | A1 * | 10/2007 | Tyrrell | 345/89 |

FOREIGN PATENT DOCUMENTS

| | | |
|---|---|---|
| CN | 1608227 A | 4/2005 |
| CN | 1722213 A | 1/2006 |

OTHER PUBLICATIONS

Office Action issued in corresponding Chinese Patent Application No. 200710126010X; mailed Mar. 6, 2009.
Office Action issued in corresponding Taiwan Patent Application No. 096123891, mailed May 24, 2012.

* cited by examiner

*Primary Examiner* — Grant Sitta
(74) *Attorney, Agent, or Firm* — Brinks Hofer Gilson & Lione

(57) ABSTRACT

A liquid crystal display (LCD) device with a register-type gamma reference voltage generating unit inside a data driving IC, thus to remove a source block dim phenomenon in a Chip on Glass (COG) cascade structure, and a driving method thereof. The LCD device comprises an LCD panel on which a plurality of gate lines and data lines intersect with each other. A TFT is formed at each intersection, to thus define images. A data driving unit supplies a gradation voltage to the LCD panel through a gamma voltage generating unit. A gate driving unit supplies a gate pulse to each gate line on the LCD panel. A timing controller controls the gate driving unit, the data driving unit and the gamma voltage generating unit.

24 Claims, 4 Drawing Sheets

LIQUID CRYSTAL DISPLAY DEVICE AND DRIVING METHOD THEREOF

RELATED APPLICATION

The present disclosure relates to a subject matter contained in priority Korean Application No. 10-2006-0061634, filed on Jun. 30, 2006, which is herein expressly incorporated by reference in its entirety.

BACKGROUND

The present invention relates to a liquid crystal display device, and particularly, to a liquid crystal display device with a register-type gamma reference voltage generating unit inside a data driving IC, to remove a source block dim phenomenon in a Chip on Glass (COG) cascade structure, and a driving method thereof.

In general, a Liquid crystal display (LCD) device has an optical anisotropy that it obtains when arranging liquid crystals with a thin and long molecular structure. A polarization of the molecular arrangement direction is changed according to the size of an electric field when the liquid crystals are arranged in the electric field.

The LCD device essentially has an LCD panel provided with a pair of transparent insulating substrates with a liquid crystal layer interposed therebetween so as to form electric field generating electrodes at their facing surfaces, respectively.

The LCD device artificially controls an arrangement direction of liquid crystal molecules by changing the electric field between the electric field generating electrodes, and displays various images using light transmissivity that is changed by controlling the arrangement direction.

Liquid crystal cells are arranged in a matrix. In order to drive the LCD panel, many peripheral driving circuits surrounding the LCD panel are required.

For example, the LCD panel may comprise a gate driving unit for driving gate lines, a data driving unit for driving data lines, a timing controller for controlling a driving timing of the gate and data driving units, and a power source unit for supplying power source signals required to drive the LCD panel and the driving units.

The gate and data driving units are divided into a plurality of integrated circuits (ICs) to be fabricated in a chip shape.

The integrated driving ICs may respectively be mounted on an IC region, opened on a TCP (Tape Carrier Package) or on a base film of the TCP, by a COF (Chip on Film) method, and may be electrically connected to the LCD panel by a TAB (Tape Automated Bonding) method.

The driving ICs may be directly mounted on the LCD panel by a COG (Chip On Glass) method. The timing controller and the power source unit may be fabricated in chip shapes to be mounted on a main PCB (Printed Circuit Board).

First, the driving ICs connected to the LCD panel by the TCP method are connected to the timing controller and the power source unit on the main PCB via a FPC (Flexible Printed Circuit) and a sub PCB.

In detail, the data driving ICs may receive data control signals and pixel data from the timing controller, which is mounted on the main PCB, and power source signals from the power source unit, all via a data FPC and a data PCB.

The gate driving ICs may receive gate control signals from the timing controller, which is mounted on the main PCB, and power source signals from the power source unit, all via a gate FPC and a gate PCB.

On the other hand, the driving ICs mounted on the LCD panel by the COG method may receive control signals and pixel data from the timing controller, which is mounted on the main PCB, and power source signals from the power source unit, all via the FPC and LOG (Line On Glass) types of signal lines formed on the LCD panel.

In the COG method of the related art, as shown in FIG. 1, FPC wires (lines) corresponding to the number of gamma reference voltages are provided between a man PCB 10 and a data driving IC 14.

Accordingly, a certain gamma reference voltage is applied to a gradation voltage generating unit, which is configured in the data driving IC 14, to create a corresponding gradation voltage. Images can thus be displayed on the LCD panel by the gradation voltage.

However, in the related art, as shown in FIG. 1, a gamma reference voltage generating unit is formed outside the data driving IC 14. A gamma reference voltage, which has been normally applied from the gamma reference voltage generating unit, is applied differently to each data driving IC 14 due to line resistance occurred by the LOG types of signal lines. Accordingly, a different gradation voltage may be created.

In other words, a uniform voltage may not be transferred to a data driving IC, which is located far from the gamma reference voltage generating unit.

As a result, overall resolution of the LCD panel may be unbalanced, namely, an inter-block dim phenomenon may occur.

SUMMARY

Therefore, in order to solve those problems of the related art, an object of the present invention is to provide a liquid crystal display (LCD) device with a register-type gamma reference voltage generating unit inside a data driving IC, thus to remove a source block dim phenomenon in a Chip on Glass (COG) cascade structure, and a driving method thereof.

To achieve these and other advantages and in accordance with the purpose of the present invention, as embodied and broadly described herein, there is provided an LCD device that comprises an LCD panel on which a plurality of gate lines and data lines intersect with each other and a TFT is formed at each intersection, thus to define images. A data driving unit supplies a gradation voltage to the LCD panel through a gamma voltage generating unit. A data driving unit supplies a gate pulse to each gate line on the LCD panel. A timing controller controls the gate driving unit, the data driving unit and the gamma voltage generating unit.

In accordance with another embodiment of the present invention, there is provided an LCD device that comprises a shift register unit that shifts a source start pulse (SSP) from a timing controller based upon a source sampling clock signal (SSC), to thus generate a sampling signal. A data register unit temporarily stores digital video data (RGB) from the timing controller. A latch unit latches the digital video data form the data register unit in response to the sampling signal sequentially inputted from the shift register unit, and outputs the latched data immediately when it receives a source output enable signal (SOE) from the timing controller. A gamma voltage generating unit for outputs a gamma voltage in correspondence to gradation voltage selection data inputted from the timing controller. A DAC selects/outputs the gamma voltage from the gamma voltage generating unit in correspondence to data stored according to a polarization control signal (POLC1) from the timing controller. An output unit holds a pixel voltage signal from the DAC.

In accordance with an embodiment of the present invention, there is provided with an LCD device driving method wherein an LCD panel is provided. The LCD panel includes a plurality of gate lines and data lines that intersect with each other. Each or the plurality of gate lines and data lines configure a gate driving unit and a data driving unit. A TFT is formed at each intersection, so as to define images. A gradation voltage is applied to the LCD panel using a gamma voltage generating unit. A gate pulse is applied to each gate line on the LCD panel. The gate driving unit, the data driving unit and the gamma voltage generating unit are controlled by a timing controller.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of an LCD device and a driving method thereof according to the present invention, with reference to the accompanying drawings.

Figure 1:
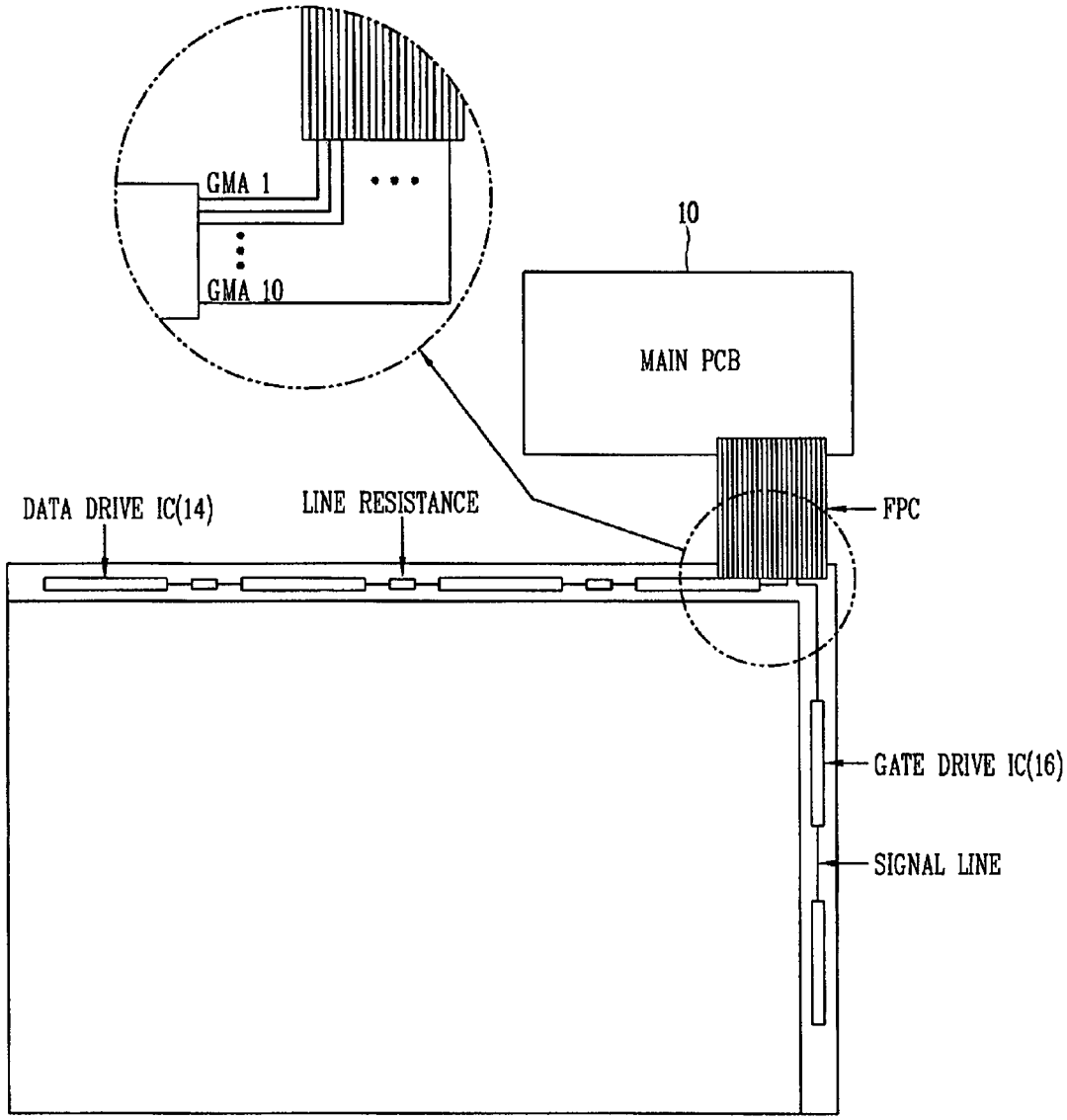
FIG. 1 RELATED ART
FIG. 1 illustrates a connection state between a gamma reference voltage generating unit on a main PCB and a data driving IC according to the related art.
Figure 2:
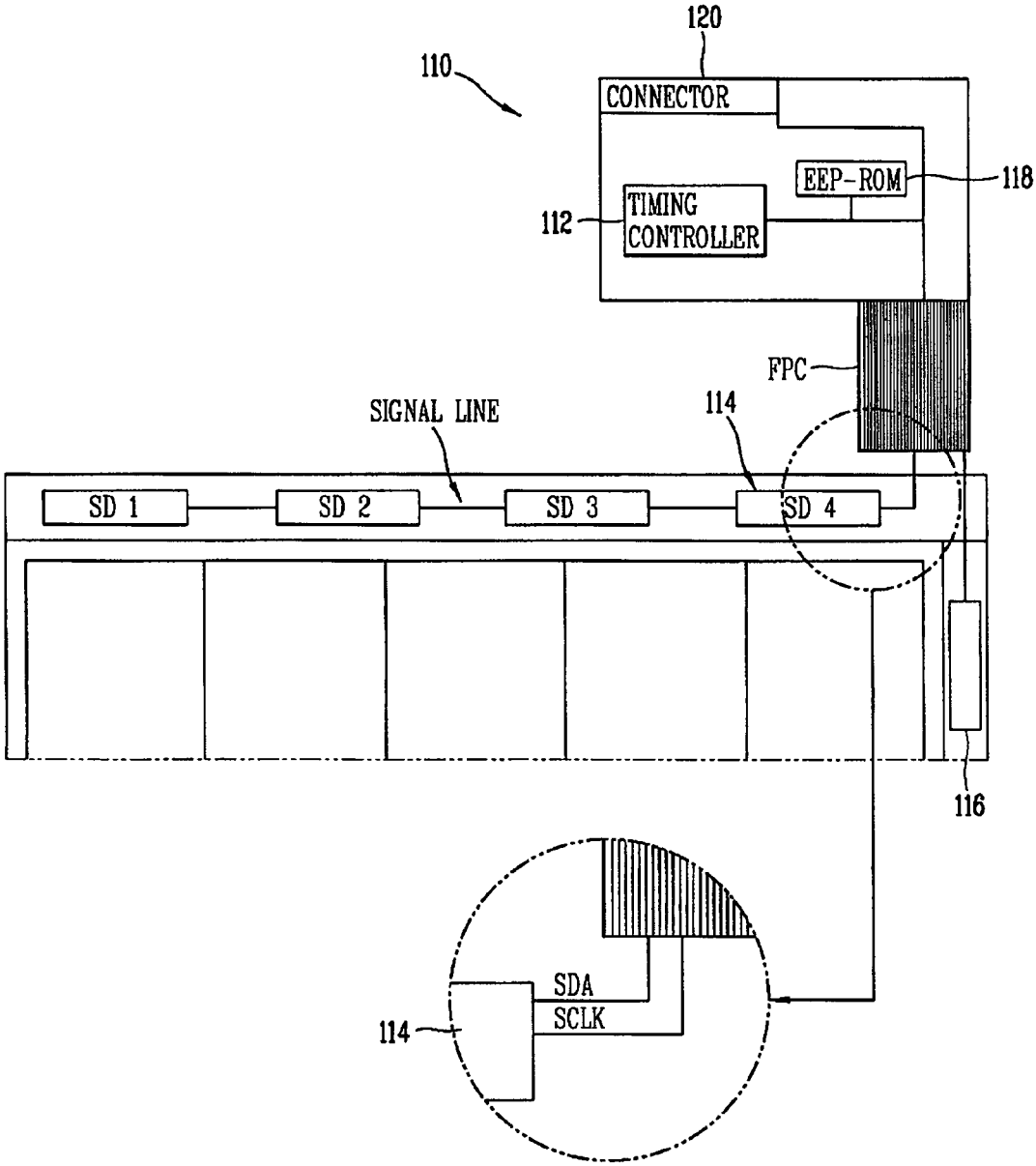
FIG. 2 illustrates a connection state between a main PCB and a gamma voltage generating unit formed inside a data driving IC, in an LCD device according to an embodiment.

FIG. 2 illustrates a connection state between a main PCB and a gamma voltage generating unit formed inside a data driving IC, in an LCD device.

As illustrated in FIG. 2, independent of an external interface, on the main PCB are formed an additionally-formed EEP-ROM (Electrically Erasable Programmable ROM) 118, a connector 120 through which information is inputted from the exterior into the EEP-ROM 118 when required, a timing controller for controlling a gamma voltage generating unit disposed inside a data driving unit 114 according to the information inputted in the EEP-ROM 118, and a FPC (Flexible Printed Circuit), such as a serial data (SDA) line and a serial clock (SCLK) line, for connecting the timing controller 112 and the gamma voltage generating unit disposed inside the data driving unit 114.

Here, the timing controller 112 of the LCD device rearranges digital video data provided from the exterior and supplies the rearranged data to the data driving unit 114. The timing controller 112 also generates a data driving control signal (DDC) and a gate driving control signal (GDC) using horizontal/vertical synchronous signals H and V and a clock signal (CLK).

The data driving control signal denotes a signal including a source shift clock (SSC), a source start pulse (SSP), a polarization control signal (POL), a source output enable signal (SOC), and the like.

Those signals are supplied to the data driving unit 114. Gate driving control signals (GDC), such as a gate start pulse (GSP), a gate shift clock (GSC), a gate output enable (GOE), and the like, are supplied to a gate driving unit 116.

The timing controller 112, for example, is interworked with its neighboring EEP-ROM 118 when initiating an LCD TV, thereby reading out gradation voltage selection data stored in the EEP-ROM 118. Also, the timing controller 112 controls a gamma voltage generating unit formed in the data driving unit 114 according to the gradation voltage selection data information.

To this end, a RAM (not shown) with, for example, approximately 8-bit capacity is separately required.

In this case, an address of a register and 8-bit gradation voltage selection data stored in the EEP-ROM 118 can be inputted (added), if required, via an external connector 120. Accordingly, a ROM replacement is not required.

Also, the gate driving unit 116 sequentially generates scan pulses, namely, gate high pulses in response to the gate driving control signal (GDC) supplied from the timing controller 112.

The gate driving unit 116, although not shown, may include a shift register for sequentially generating scan pulses, and a level shift for shifting a swing width of a scan pulse voltage over a threshold voltage of TFT.

The data driving unit 114 supplies data to each data line in response to the data driving control signal (DDC) supplied from the timing controller 112.

In more detail, the data driving unit 114 samples the digital video data (RGB) from the timing controller 112 and then latches the sampled data. The data driving unit 114 selects a gradation voltage appropriate for the latched data and then converts the selected gradation voltage into an analog voltage, thereby defining a gradation on each liquid crystal cell.

Here, the gradation voltage may be selected by using gradation voltage selection data outputted from a gamma voltage generating unit by an IIC communication method.

Figure 3:
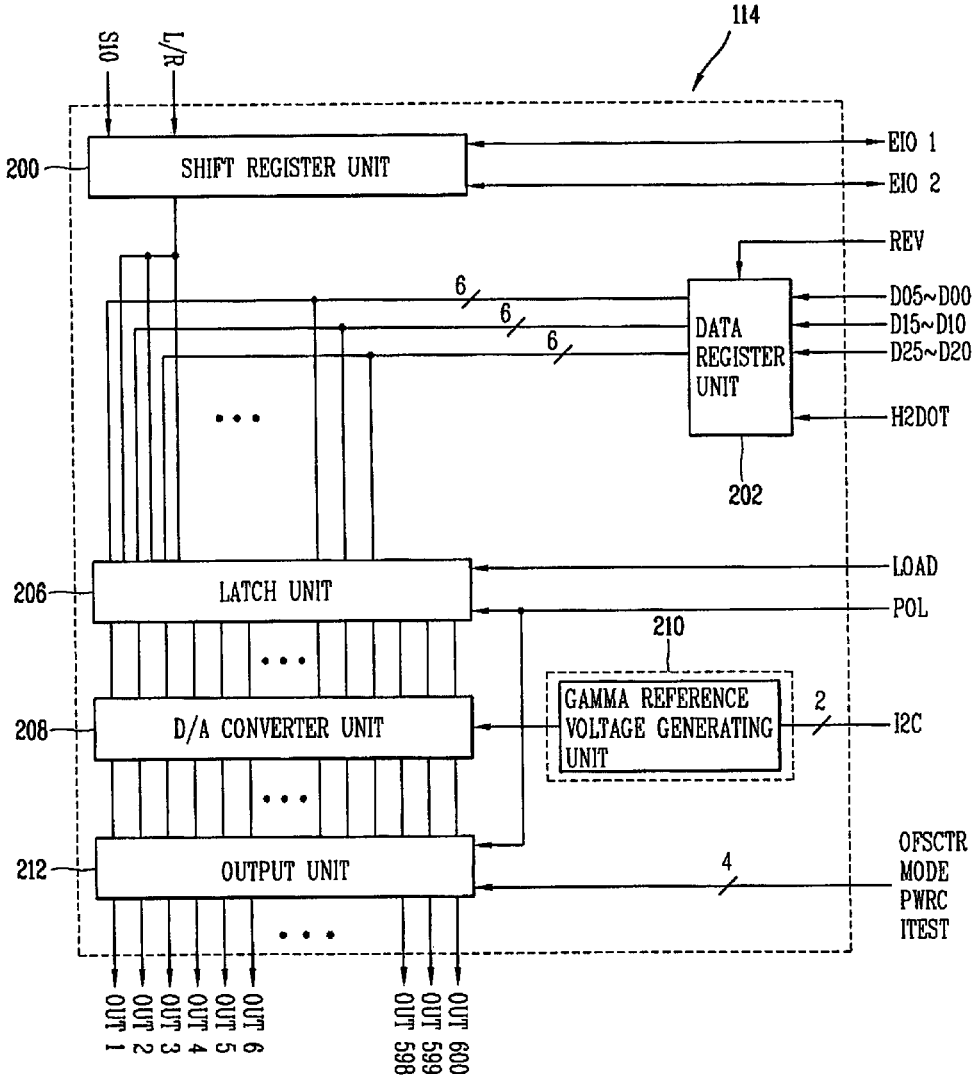
FIG. 3 is a block diagram illustrating an internal configuration of the data driving IC of FIG. 2.

With reference to FIG. 3, a detailed configuration of the data driving unit of the LCD device according to an embodiment will be described as follows.

FIG. 3 is a block diagram illustrating an internal configuration of the data driving IC of FIG. 2.

As illustrated in FIG. 3, the shift register unit 200 shifts a source start pulse (SSP) from the timing controller 112 according to a source sampling clock signal (SSC), thereby generating a sampling signal.

The shift register unit 200 is implemented in plurality on the LCD panel. Accordingly, a source start pulse (SSP) of a first shift register unit is shifted and then a carrier signal (CAR) is transferred to the next shift register unit.

A data register unit 202 temporarily stores the data (RGB) from the timing controller 112, and thereafter supplies the stored data to a latch unit 206.

The latch unit 206 responds to the sampling signal sequentially inputted from the shift register unit 200, thus to latch the video data (RGB) from the data register unit 202 by each one line.

In addition, after latching the inputted video data, the latch unit 206 outputs the latched video data (RGB) immediately when receiving a source output enable signal (SOE) from the timing controller 112.

A DAC 208 selects and outputs a gradation voltage with a corresponding level supplied from the gamma voltage generating unit 210 when receiving the video data from the latch unit 206.

The gradation voltage may be outputted as a voltage having either positive polarity or negative polarity according to the polarization control signal from the timing controller 112.

The gamma voltage generating unit 210 provides the DAC 208 with the selected gamma voltage in response to the gamma voltage selection data from the timing controller 112 according to I2C (or IIC) communication method.

The output unit 212 supplies a voltage which is converted into an analog voltage by the DAC 208 to each data line. The output unit 212 has buffers for minimizing attenuation of the supplied voltage.

Figure 4:
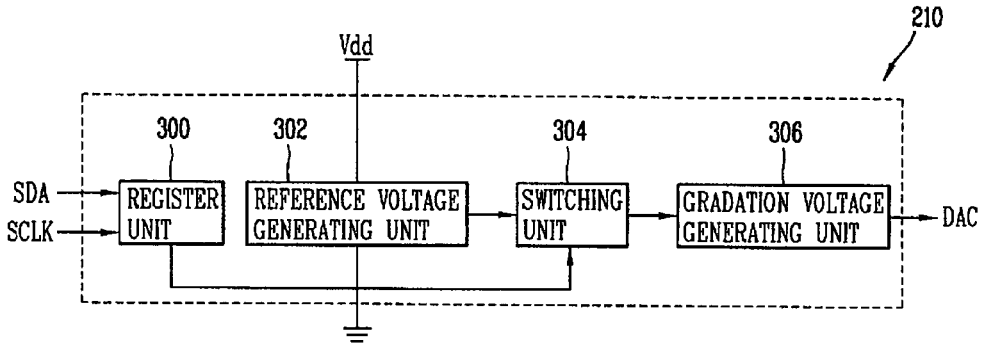
FIG. 4 is a block diagram illustrating an internal configuration of a gamma voltage generating unit of FIG. 3 in an LCD device according to one embodiment.

With reference to FIG. 4, description will be given in detail of a configuration of the gamma voltage generating unit provided in the data driving unit of the LCD device according to the present invention as follows.

FIG. 4 illustrates one embodiment of the gamma voltage generating unit 210 formed inside the data driving IC 114 of FIG. 3.

Referring to FIG. 4, the gamma voltage generating unit 210 disposed inside the data driving unit 114 of the LCD device may comprise a reference voltage generating unit 302 for dividing a power source terminal voltage Vdd applied from an external power source unit through a plurality of serial resistance (e.g., about 10 resistance), a switching unit 304 interworked with the reference voltage generating unit 302 and having a plurality of switching elements, a register unit 300 for storing the gradation voltage selection data from the timing controller 112, and a gradation voltage generating unit 306 provided with a plurality of serial resistance (e.g., about 64-256 resistance) for dividing the voltage which has been selected and outputted from the switching unit 304 according to the gradation voltage selection data from the register unit 300.

Here, the switching unit 304 may include elements therein, such as the resistance, the register and FETs (Field Effect Transistors).

A description will be given of a detailed configuration of another embodiment of the gamma voltage generating unit inside the data driving unit of the LCD device according to the present invention with reference to FIG. 5 as follows.

Figure 5:
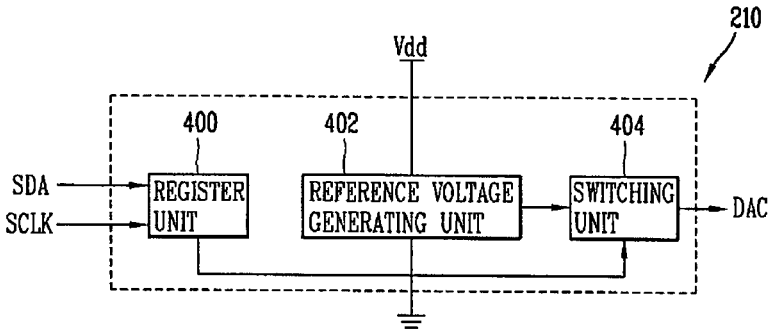
FIG. 5 is a block diagram illustrating an internal configuration of the gamma voltage generating unit of FIG. 3 according to another embodiment.

FIG. 5 illustrates another embodiment of the gamma voltage generating unit 210 formed inside the data driving IC 114 of FIG. 3.

Referring to FIG. 5, the gamma voltage generating unit 210 disposed inside the data driving unit 114 of the LCD device according to another embodiment may comprise a reference voltage generating unit 402 for dividing the power source terminal voltage Vdd applied from an external power source unit by directly connecting about 64 to 256 resistance in series, without passing through the reference voltage generating unit 302 as shown in FIG. 4, a switching unit 404 interworked with the reference voltage generating unit 402 and having a plurality of switching elements, and a register unit 400 for storing gradation voltage selection data from the timing controller.

According to the construction, a description will be given of an operational principle that the register-type gamma voltage generating unit disposed in the data driving IC outputs a gamma voltage from the timing controller according to IIC communication protocol.

First, EEP-ROM on a main PCB stores an address of a register disposed in a data driving unit and 8-bit gradation voltage selection data.

The gradation voltage selection data is used for controlling the aforementioned switching units 304 or 404.

For example, a timing controller of an LCD device, such as LCD TV, primarily reads out gradation voltage selection data stored in a type of a look-up table from the EEP-ROM via an external connector, using an internal program upon the initial driving, namely, using an IIC (Inter-integrated Circuit) communication method via two lines of SDA and SCLK.

Afterwards, the gradation voltage selection data is temporarily stored in a RAM disposed in the timing controller and then the temporarily-stored gradation voltage selection data is set in a register disposed in the data driving IC. Such operations are repeatedly performed.

As illustrated in FIG. 4, for controlling ten or less gamma reference voltages, the operations are repeatedly performed, such as reading data stored in the type of the look-up table out of the EEP-ROM, temporarily storing the read data in the RAM inside the timing controller, and setting the data in the register 300 disposed inside the data driving IC.

After completing the initial processes, the gamma voltage generating unit 210 controls the switching unit 304 satisfied with the condition of the gradation voltage selection data, thereby selecting corresponding voltages from the reference voltage generating unit 302.

The selected voltages are passed through the gradation voltage generating unit 306 having a plurality of serial resistance or through a voltage distributing unit to be supplied to a DAC (Digital to Analogue Converter).

As illustrated in FIG. 5, the power source terminal voltage Vdd from the exterior is directly divided according to the corresponding gradation voltage.

For example, in order to store the corresponding gradation voltage selection data in the register unit 400 using approximately 64 serial resistance or 356 serial resistance, the timing controller primarily reads out the data stored in the EEP-ROM upon the initial driving. The timing controller then temporarily stores the read data in the RAM disposed in the timing controller, and thereafter sets the data in the register 400 disposed in the data driving IC. Such operations are repeatedly performed.

In FIG. 5, after completing the initial processes, the gamma voltage generating unit 210 controls the switching unit 404 satisfied with the condition of the gradation voltage selection data, such that the corresponding voltages selected from the reference voltage generating unit 402 are directly supplied to the DAC. This is different from FIG. 4.

Figure 6:
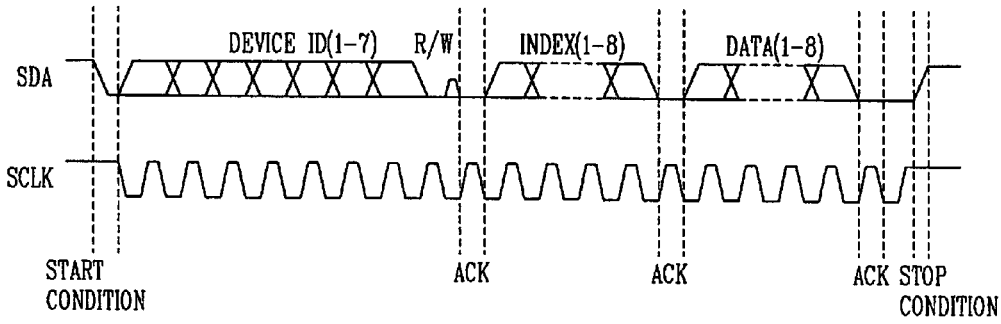
FIG. 6 illustrates a data structure used in an IIC communication.

FIG. 6 illustrates a timing relationship of the aforementioned IIC communication protocol used in the described structure.

The timing relationship of the protocol for the IIC communication will be briefly explained as follows.

As illustrated in FIG. 6, a state transition related to message 'start' (start condition) and message 'stop' (stop condition) is generated at a SDA signal, while a SCLK signal is generated at a logic 1 in an idle state in which no communication is ongoing.

Each clock pulse on the SCLK existing between the message start condition and the message stop condition denotes the generation of data bit on the SDA signal.

Therefore, the register use the clock pulse to store data bit.

A receiver, such as EEP-ROM or gamma voltage register having an identification number, sequentially transmits a message start signal and a 8-bit (i.e., 1 byte) signal, so as to interpret a data signal transmitted from the timing controller.

After transmitting the 8-bit signal for setting the device ID, about 1 byte of another signal for setting an address of the register in the device and 1 byte signal for indicating data are sequentially transmitted.

The device ID, the address or the data signal

An acknowledgement bit ACK providing "handshaking", a type of reconciliatory gesture between signals is additionally added between the receiver and the timing controller, in order to inform the reception of a new signal (e.g., the signal for the device ID, the signal for the address or the data signal.

As described above, the following effect can be achieved by the LCD device and the driving method thereof.

In the disclosed LCD device, the existing source block dim phenomenon can be removed by forming the gamma voltage generating unit in the data driving IC in the COG cascade structure and controlling the gamma voltage generating unit according to the IIC communication method.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A liquid crystal display (LCD) device comprising: an LCD panel on which a plurality of gate lines and data lines intersect with each other and a TFT is formed at each intersection, to define images;

a data driving unit that supplies a gradation voltage to the LCD panel through a gamma voltage generating unit, wherein the gamma voltage generating unit is inside the data driving unit;

a gate driving unit that supplies a gate pulse to each gate line on the LCD panel; and wherein the gamma voltage generating unit comprises a reference voltage generating unit that divides a power source terminal voltage applied from an external power source unit via at least 10 serial resistance; a switching unit interworked with the reference voltage generating unit and having a plurality of switching elements; and a register unit interworked with the switching unit and storing gradation voltage selection data from the timing controller; and a gradation voltage generating unit having at least 64 serial resistance that re-divides the voltage outputted from the switching unit according to the gradation voltage selection data from the register unit;

an EEP-ROM (Electrically Erasable Programmable ROM) formed on a main PCB stores an address of the register unit and 8-bit gradation voltage selection data for controlling the switching unit;

wherein the timing controller transits each 1-byte signal for setting device ID, for setting an address of the register in the device and for transmitting the gradation voltage selection data to the gamma voltage generating unit; and wherein the timing controller primarily reads out 8-bit gradation voltage selection data from the EEP-ROM, upon the initial driving, using an IIC (Inter-Integrated Circuit) communication method and temporarily stores 8-bit gradation voltage selection data in a RAM disposed therein, and thereafter sets 8-bit gradation voltage selection data in the register unit.

2. The LCD device of claim 1, wherein the data driving unit is formed according to a chip-on glass method.

3. The LCD device of claim 1, wherein the data driving unit comprises:

shift register unit that shifts a source start pulse according to a source sampling clock signal from the timing controller to generate a sampling signal;

a data register unit that temporarily stores digital video data from the timing controller;

a latch unit that samples the digital video data from the data register unit in response to the sampling signal sequentially inputted from the shift register unit, latches the sampled data by one line, and outputs the latched data immediately when receiving a source output enable signal from the timing controller;

a gamma voltage generating unit that outputs a gamma voltage in response to gradation voltage selection data inputted from the timing controller;

a DAC that selects/outputs a gamma voltage from the gamma voltage generating unit in response to the data inputted from the latch unit according to a polarization control signal from the timing controller; and an output unit that holds the gradation voltage from the DAC in a buffer.

4. The LCD device of claim 1, wherein the register of the gamma voltage generating unit comprises a RAM with at least 64-byte capacity.

5. The LCD device of claim 1, wherein the gamma voltage generating unit is connected to the timing controller via two lines.

6. The LCD device of claim 1, wherein the gamma voltage generating unit further comprises: a gradation voltage generating unit having at least 64 serial resistance that re-divides the voltage outputted from the switching unit according to the gradation voltage selection data from the register unit;

a gradation voltage generating unit that divides a power source terminal voltage applied from an external power source unit via at least 64 serial resistance;

a switching unit interworked with the gradation voltage generating unit and having a plurality of switching elements; and a register unit interworked with the switching unit and storing gradation voltage selection data from the timing controller.

7. The LCD device of claim 3, wherein the gamma voltage generating unit is provided in each data driving unit.

8. A data driving circuit in a liquid crystal display (LCD) device comprising:

a shift register unit that shifts a source start pulse from a timing controller according to a source sampling clock signal, to generate a sampling signal;

a data register unit that temporarily stores digital video data from the timing controller;

a latch unit that latches the digital video data from the data register unit in response to the sampling signal sequentially inputted from the shift register unit, and outputs the latched data immediately when receiving a source output enable signal from the timing controller;

a gamma voltage generating unit that outputs a gamma voltage in response to gradation voltage selection data inputted from the timing controller, wherein the gamma voltage generating unit comprises a reference voltage generating unit that primarily divides a power source terminal voltage applied from an external power source unit via at least 10 serial resistance; a switching unit interworked with the reference voltage generating unit and having a plurality of switching elements; and a register unit interworked with the switching unit and storing gradation voltage selection data from the timing controller; and a gradation voltage generating unit having at least 64 serial resistance that re-divides the voltage outputted from the switching unit according to the gradation voltage selection data from the register unit, wherein the gamma voltage generating unit is inside the data driving unit;

a DAC (Digital to Analogue Converter) that selects/outputs a gamma voltage from the gamma voltage generating unit in response to the data stored in the latch unit according to a polarization control signal from the timing controller; and an output unit that holds a pixel voltage signal from the DAC; wherein the timing controller transits each 1-byte signal for setting device ID, for setting an address of a register in the device and for transmitting the gradation voltage selection data to the gamma voltage generating unit, and an EEP-ROM (Electrically Erasable Programmable ROM) formed on a main PCB stores an address of the register unit and 8-bit gradation voltage selection data for controlling the switching unit;

wherein the EEP-ROM is interworked with a connector through which the gradation voltage selection data is inputted therein; and wherein the timing controller primarily reads out 8-bit gradation voltage selection data from the EEP-ROM, upon the initial driving, using an IIC (Inter-Integrated Circuit) communication method and temporarily stores 8-bit gradation voltage selection data in a RAM disposed therein, and thereafter sets 8-bit gradation voltage selection data in the register unit.

9. The circuit of claim 8, wherein the register of the gamma voltage generating unit comprises a RAM with at least 64-byte capacity.

10. The circuit of claim 8, wherein the gamma voltage generating unit is connected to the timing controller via two lines.

11. The circuit of claim 8, wherein the gamma voltage generating unit further comprises:

a gradation voltage generating unit having at least 64 serial resistance that re-divides the voltage outputted from the switching unit according to the gradation voltage selection data from the register unit;

a gradation voltage generating unit that divides a power source terminal voltage applied from an external power source unit via at least 64 serial resistance;

a switching unit interworked with the gradation voltage generating unit and having a plurality of switching elements; and a register unit interworked with the switching unit and storing gradation voltage selection data from the timing controller.

12. The circuit of claim 8, wherein the gamma voltage generating unit is provided in each data driving unit.

13. A driving method of a liquid crystal display (LCD) device comprising:

providing an LCD panel, on which a plurality of gate lines and data lines, each configuring a gate driving unit and a data driving unit, intersect with each other, and a TFT is formed at each intersection, so as to define images;

applying a gradation voltage to the LCD panel through a gamma voltage generating unit, wherein the gamma voltage generating unit comprises a reference voltage generating unit that divides a power source terminal voltage applied from an external power source unit via at least 10 serial resistance; a switching unit interworked with the reference voltage generating unit and having a plurality of switching elements; and a register unit interworked with the switching unit and storing gradation voltage selection data from the timing controller, wherein the gamma voltage generating unit is inside the data driving unit; and providing a gradation voltage generating unit having at least 64 serial resistance that re-divides the voltage outputted from the switching unit according to the gradation voltage selection data from the register unit;

applying a gate pulse to each gate line on the LCD panel; and controlling the gate driving unit, the data driving unit and the gamma voltage generating unit by a timing controller;

transmitting, by the timing controller, each 1-byte signal for setting device ID, for setting an address of a register in the device and for transmitting the gradation voltage selection data to the gamma voltage generating unit;

storing, by an EEP-ROM (Electrically Erasable Programmable ROM) formed on a main PCB, an address of the register unit and 8-bit gradation voltage selection data for controlling the switching unit;

wherein the EEP-ROM is interworked with a connector through which the gradation voltage selection data is inputted therein; and primarily reading out, by the timing controller, 8-bit gradation voltage selection data from the EEP-ROM upon the initial driving, using an IIC (Inter-Integrated Circuit) communication method and temporarily storing 8-bit gradation voltage selection data in a RAM disposed therein, and thereafter setting 8-bit gradation voltage selection data in the register unit.

14. The method of claim 13, wherein the data driving unit is formed according to a chip-on glass method.

15. The method of claim 13, wherein the data driving unit comprises:

a shift register unit that shifts a source start pulse according to a source sampling clock signal from the timing controller to generate a sampling signal;

a data register unit that temporarily stores digital video data from the timing controller;

a latch unit that samples the digital video data from the data register unit in response to the sampling signal sequentially inputted from the shift register unit, latches the sampled data by one line, and outputs the latched data immediately when receiving a source output enable signal from the timing controller;

a gamma voltage generating unit that outputs a gamma voltage in response to gradation voltage selection data inputted from the timing controller;

a DAC that selects/outputs a gamma voltage from the gamma voltage generating unit in response to the data inputted from the latch unit according to a polarization control signal from the timing controller; and an output unit that holds the gradation voltage from the DAC in a buffer.

16. The method of claim 13, wherein the register of the gamma voltage generating unit comprises a RAM with at least 64-byte capacity.

17. The method of claim 13, wherein the gamma voltage generating unit is connected to the timing controller via two lines.

18. The method of claim 13, wherein the gamma voltage generating unit further comprises:

a gradation voltage generating unit having at least 64 serial resistance that re-divides the voltage outputted from the switching unit according to the gradation voltage selection data from the register unit;

a gradation voltage generating unit that divides a power source terminal voltage applied from an external power source unit via at least 64 serial resistance;

a switching unit interworked with the gradation voltage generating unit and having a plurality of switching elements; and a register unit interworked with the switching unit, and storing gradation voltage selection data from the timing controller.

19. The method of claim 15, wherein the gamma voltage generating unit is provided in each data driving unit.

20. A driving method of a liquid crystal display (LCD) device comprising:

shifting a source start pulse from a timing controller based upon a source sampling clock signal thus to generate a sampling signal;

temporarily storing digital video data from the timing controller;

latching the digital video data by each one line in response to the sampling signal sequentially inputted from the shift register unit;

outputting the digital video data immediately when receiving a source output enable signal from the timing controller;

outputting a gamma voltage when receiving gradation voltage selection data inputted from the timing controller;

selecting/outputting a gamma voltage from a gamma voltage generating unit when receiving the latched data according to a polarization control signal from the timing controller, wherein the gamma voltage generating unit comprises a reference voltage generating unit that divides a power source terminal voltage applied from an external power source unit via at least 10 serial resistance; a switching unit interworked with the reference voltage generating unit and having a plurality of switching elements; and a register unit interworked with the switching unit and storing gradation voltage selection data from the timing controller, wherein the gamma voltage generating unit is inside the data driving unit; and providing a gradation voltage generating unit having at least 64 serial resistance for re-dividing the voltage outputted from the switching unit according to the gradation voltage selection data from the register unit; and holding the selected/outputted gamma voltage to output onto a panel;

wherein the timing controller received each a 1-byte signal for setting wherein the timing controller transits each a 1-byte signal for setting device ID, an address of a register in the device and the gradation voltage selection data to the gamma voltage generating unit;

storing, by an EEP-ROM (Electrically Erasable Programmable ROM) formed on a main PCB, an address of the register unit and 8-bit gradation voltage selection data for controlling the switching unit;

wherein the EEP-ROM is interworked with a connector through which the gradation voltage selection data is inputted therein; and primarily reading out, by the timing controller, 8-bit gradation voltage selection data from the EEP-ROM, upon the initial driving, using an IIC (Inter-Integrated Circuit) communication method and temporarily storing 8-bit gradation voltage selection data in a RAM disposed therein, and thereafter setting 8-bit gradation voltage selection data in the register unit.

21. The method of claim 20, wherein the register of the gamma voltage generating unit outputting the gamma voltage comprises a RAM with at least 64-byte capacity.

22. The method of claim 20, wherein the gamma voltage generating unit is connected to the timing controller via two lines.

23. The method of claim 20, wherein the gamma voltage generating unit further comprises:

a gradation voltage generating unit having at least 64 serial resistance for re-dividing the voltage outputted from the switching unit according to the gradation voltage selection data from the register unit;

a gradation voltage generating unit that divides a power source terminal voltage applied from an external power source unit via at least 64 serial resistance;

a switching unit interworked with the gradation voltage generating unit and having a plurality of switching elements; and a register unit interworked with the switching unit, and storing gradation voltage selection data from the timing controller.

24. The method of claim 20, wherein the gamma voltage generating unit is provided in each data driving unit.

* * * * *